US012385720B1

(12) United States Patent
Xu et al.

(10) Patent No.: US 12,385,720 B1
(45) Date of Patent: Aug. 12, 2025

(54) FIREARM MAGNET MOUNT WITH BARREL INSERT AND METHOD OF SECURELY HOLDING FIREARM USING THE SAME

(71) Applicants: Ye Xu, Sugar Land, TX (US); Mingshun Xiong, Wuhan (CN)

(72) Inventors: Ye Xu, Sugar Land, TX (US); Mingshun Xiong, Wuhan (CN)

( * ) Notice: Subject to any disclaimer, the term of this patent is extended or adjusted under 35 U.S.C. 154(b) by 0 days.

(21) Appl. No.: 18/934,183

(22) Filed: Oct. 31, 2024

(51) Int. Cl.
*F41C 33/02* (2006.01)
*F41C 33/04* (2006.01)

(52) U.S. Cl.
CPC ..... *F41C 33/0245* (2013.01); *F41C 33/041* (2013.01)

(58) Field of Classification Search
CPC ..... F41C 33/0245; F41C 33/048; F41C 33/0263; F41C 33/041; Y10S 224/912; Y10S 224/901
See application file for complete search history.

(56) References Cited

U.S. PATENT DOCUMENTS

| | | | | | |
|---|---|---|---|---|---|
| 2,765,107 | A * | 10/1956 | Browning | F41C 33/0245 | 224/912 |
| 2,910,804 | A * | 11/1959 | White | F41C 33/041 | D3/222 |
| 3,315,855 | A * | 4/1967 | Boone | F41C 33/041 | 224/269 |
| 9,261,328 | B2 * | 2/2016 | Sitz | F41C 33/0245 | |
| 11,002,510 | B2 * | 5/2021 | Sitz | F41C 33/041 | |
| 11,441,873 | B1 * | 9/2022 | Turner | F41G 1/38 | |
| 2012/0255979 | A1 * | 10/2012 | Sitz | F41C 33/0245 | 42/90 |

* cited by examiner

*Primary Examiner* — Corey N Skurdal
(74) *Attorney, Agent, or Firm* — George Guosheng Wang; Upstream Research and Patent LLC

(57) ABSTRACT

The present invention provides a magnet mount for securely holding a firearm. The magnet mount includes a mounting plate, one or more magnets affixed to the mounting plate, and a barrel insert that is substantially in parallel with the surface of the mounting plate. The magnets are configured for providing a holding power to support at least a portion of the weight of the firearm. The barrel insert can be inserted into the barrel of the firearm and stabilizes the firearm. Also provided is a method of securely holding a firearm using the magnet mount.

19 Claims, 9 Drawing Sheets

FIREARM MAGNET MOUNT WITH BARREL INSERT AND METHOD OF SECURELY HOLDING FIREARM USING THE SAME

FIELD OF THE INVENTION

The present invention generally relates to a firearm magnet mount with barrel insert and a method of securely holding firearms using the magnet mount. Although the invention will be illustrated, explained and exemplified by semi-automatic pistol, it should be appreciated that the present invention can also be applied to other firearms, for example, other handguns such as revolver, derringer, and machine pistol; long-barreled guns such as carbine, rifle, shotgun, submachine gun, submachine gun, and machine gun; and the like.

BACKGROUND OF THE INVENTION

Most of the population in the U.S. currently lives with a gun in their house. Just one-third of adults in the U.S. do not own a gun and cannot see themselves owning one in the future. The population of gun owners has been increasing rapidly in recent years. For example, the COVID-19 pandemic, compounded by the George Floyd protests and riots, mixed with threats of "Civil War 2" leading up to and following a hotly contested presidential election, created an unprecedented gun-buying spree in 2020. As of 2024, there are estimated to be over 466 million firearms in the United States. This includes guns owned by civilians, law enforcement, and other entities. The vast majority, over 98%, are in civilian hands, which equates to about 120 firearms per 100 citizens.

Gun mounts are devices designed to securely hold firearms in place, whether for storage, display, or tactical use. They come in various forms, including wall mounts, vehicle mounts, and specialized mounts for different types of firearms. However, the current designs of gun mounts cannot meet users' multiple needs at the same time, for example, easier operation, simpler structure, and higher stability in storage and transportation. Advantageously, the firearm mount of the present invention can satisfy these needs.

SUMMARY OF THE INVENTION

One aspect of the present invention provides a magnet mount for securely holding a firearm. The magnet mount includes a mounting plate, one or more magnets affixed to the mounting plate, and a barrel insert that is substantially in parallel with the surface of the mounting plate. The one or more magnets are configured for providing a holding power to support at least a portion of the weight of the firearm. The barrel insert can be inserted into the barrel of the firearm and stabilizes the firearm. The barrel/firearm can rotate around the barrel insert.

Another aspect of the invention provides a method of securely holding a firearm. One step of the method is providing a magnet mount as described above. Another step of the method is inserting the barrel insert into the barrel of the firearm so that the barrel can rotate around the barrel insert and the one or more magnets can provide a holding power to support at least a portion of the weight of the firearm. Some embodiments include a step of rotating the firearm around the barrel insert and/or rotating the barrel insert around a rotatably adjustable shaft, to adjust the interface between the mounting plate and the firearm. Other embodiments include a step of withdrawing the firearm from the barrel insert, before completely disengaging/separating the firearm from the magnet mount.

The above features and advantages and other features and advantages of the present invention are readily apparent from the following detailed description of the best modes for carrying out the invention when taken in connection with the accompanying drawings.

BRIEF DESCRIPTION OF THE SEVERAL VIEWS OF THE DRAWINGS

The present invention is illustrated by way of example, and not by way of limitation, in the figures of the accompanying drawings and in which like reference numerals refer to similar elements. All the figures are schematic and generally only show parts which are necessary in order to elucidate the invention. For simplicity and clarity of illustration, elements shown in the figures and discussed below have not necessarily been drawn to scale. Well-known structures and devices are shown in simplified form, omitted, or merely suggested, in order to avoid unnecessarily obscuring the present invention.

DETAILED DESCRIPTION OF THE PREFERRED EMBODIMENT

In the following description, for the purposes of explanation, numerous specific details are set forth in order to provide a thorough understanding of the present invention. It is apparent, however, to one skilled in the art that the present invention may be practiced without these specific details or with an equivalent arrangement.

Where a numerical range is disclosed herein, unless otherwise specified, such range is continuous, inclusive of both the minimum and maximum values of the range as well as every value between such minimum and maximum values. Still further, where a range refers to integers, only the integers from the minimum value to and including the maximum value of such range are included. In addition, where multiple ranges are provided to describe a feature or characteristic, such ranges can be combined.

It is also to be understood that the terminology used herein is for the purpose of describing particular embodiments only, and is not intended to limit the scope of the invention. For example, when an element is referred to as being "on", "connected to", or "coupled to" another element, it can be directly on, connected or coupled to the other element or intervening elements may be present. In contrast, when an element is referred to as being "directly on", "directly connected to", or "directly coupled to" another element, there are no intervening elements present.

Throughout the specification and claims, the following terms take the meanings explicitly associated herein, unless the context clearly dictates otherwise. The phrase "in one embodiment" does not necessarily refer to the same embodiment, although it may. Furthermore, the phrase "in another embodiment" does not necessarily refer to a different embodiment, although it may. Thus, as described below, various embodiments of the invention may be readily combined without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

Figure 1:
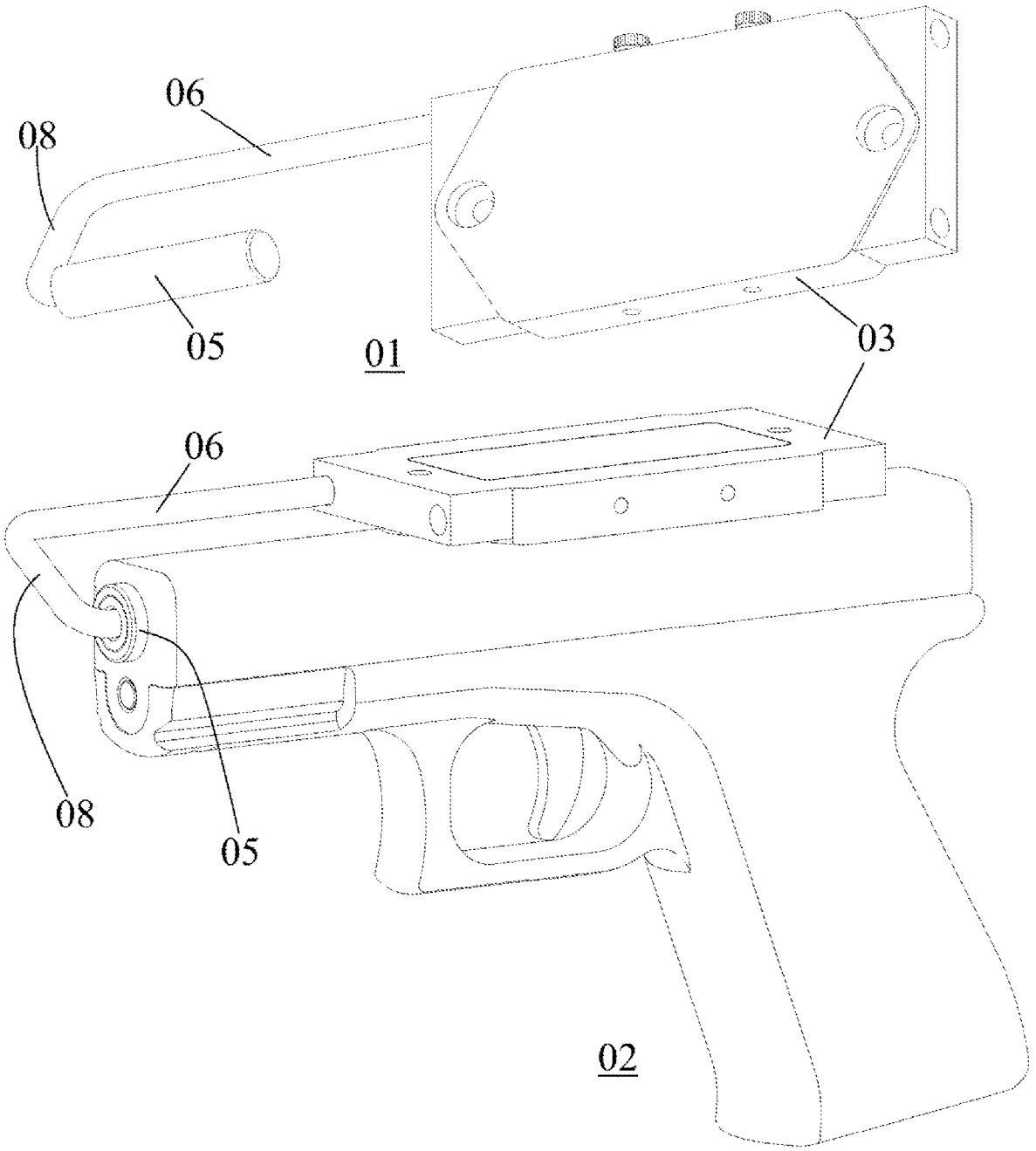
FIG. 1 schematically shows a magnet mount designed for securely holding a firearm in accordance with an exemplary embodiment of the present invention.
Figure 2:
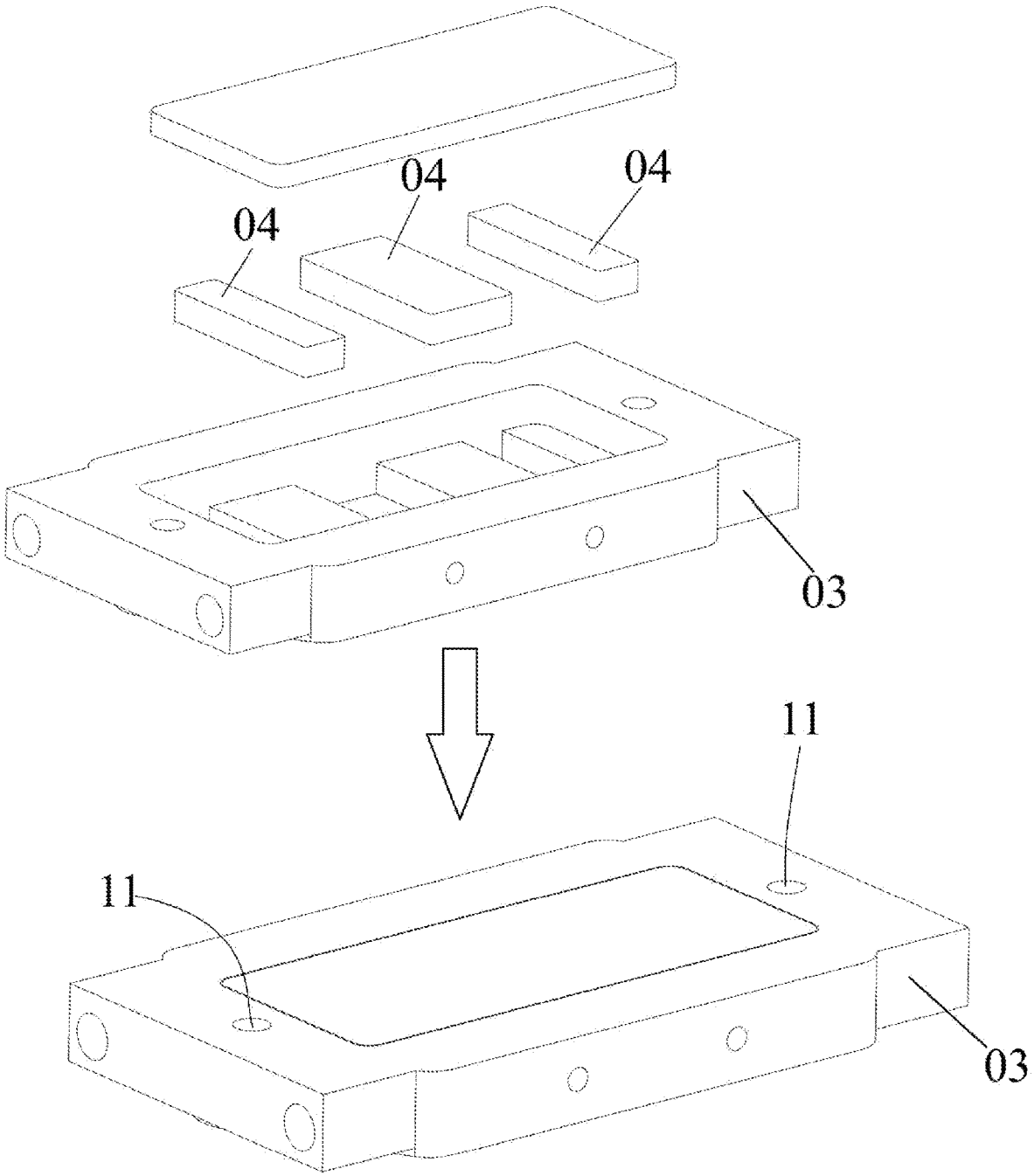
FIG. 2 illustrates a few magnets encased within a mounting plate of the magnet mount in accordance with an exemplary embodiment of the present invention.

Referring now to FIG. 1, various embodiments of the present invention provide a magnet mount 01 for securely holding a firearm 02. Magnet mount 01 includes a mounting plate 03. One or more magnets 04 as shown in FIG. 2 may be affixed to the mounting plate 03.

Figure 3:
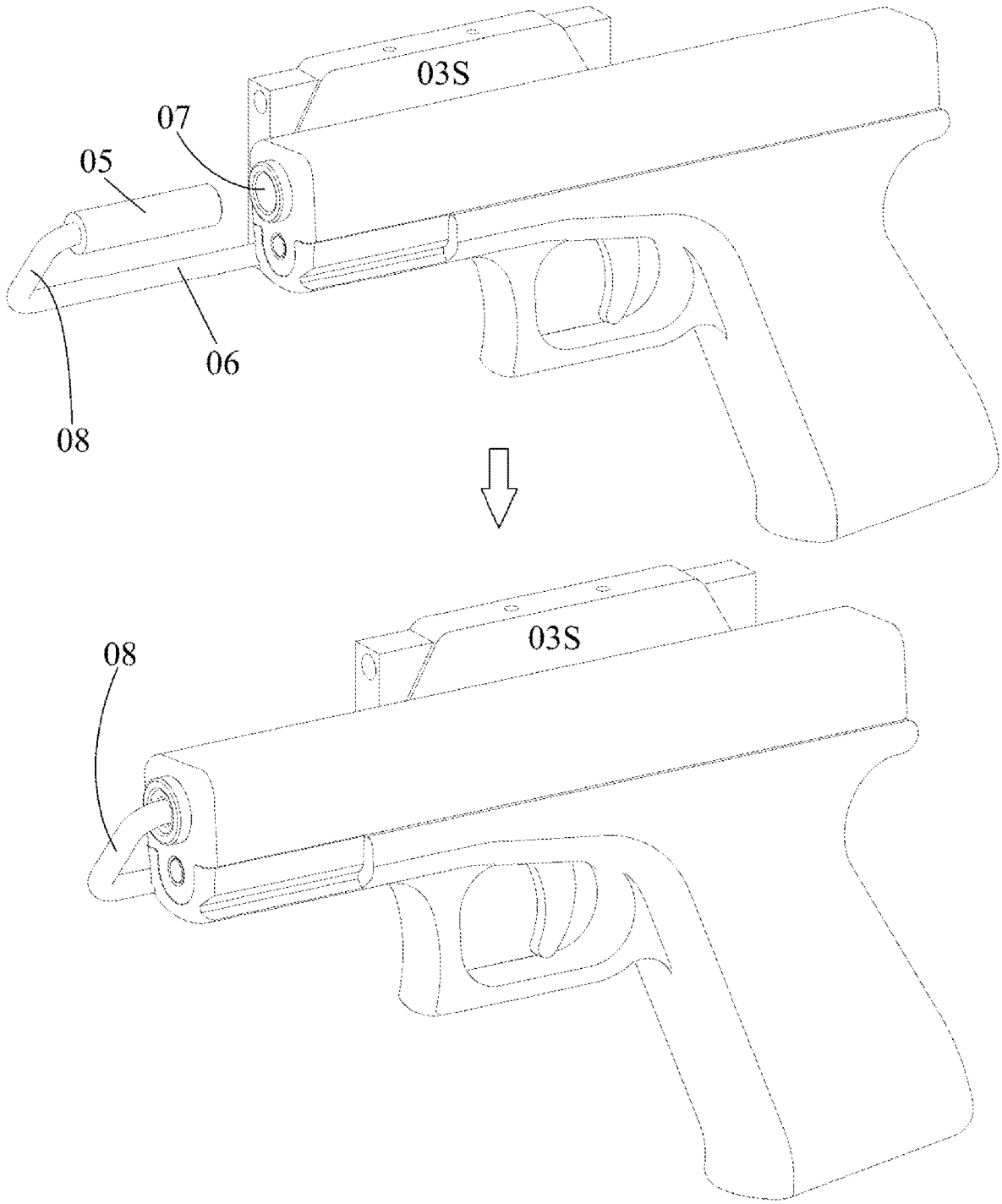
FIG. 3 schematically illustrates a side magnet mount in accordance with an exemplary embodiment of the present invention.

Magnet mount 01 includes a barrel insert 05 that is substantially in parallel with a surface 03S of the mounting plate 03, as shown in FIG. 3. Barrel insert 05 can be inserted into barrel 07 of the firearm 02 and stabilizes the firearm 02. The barrel 07/firearm 02 can rotate around the barrel insert 05. These magnets 04 are configured for providing a holding power to support at least a portion of the weight of the firearm 02. The remaining portion of the weight of the firearm 02 (if any) may be supported by the barrel insert 05.

Figure 8:
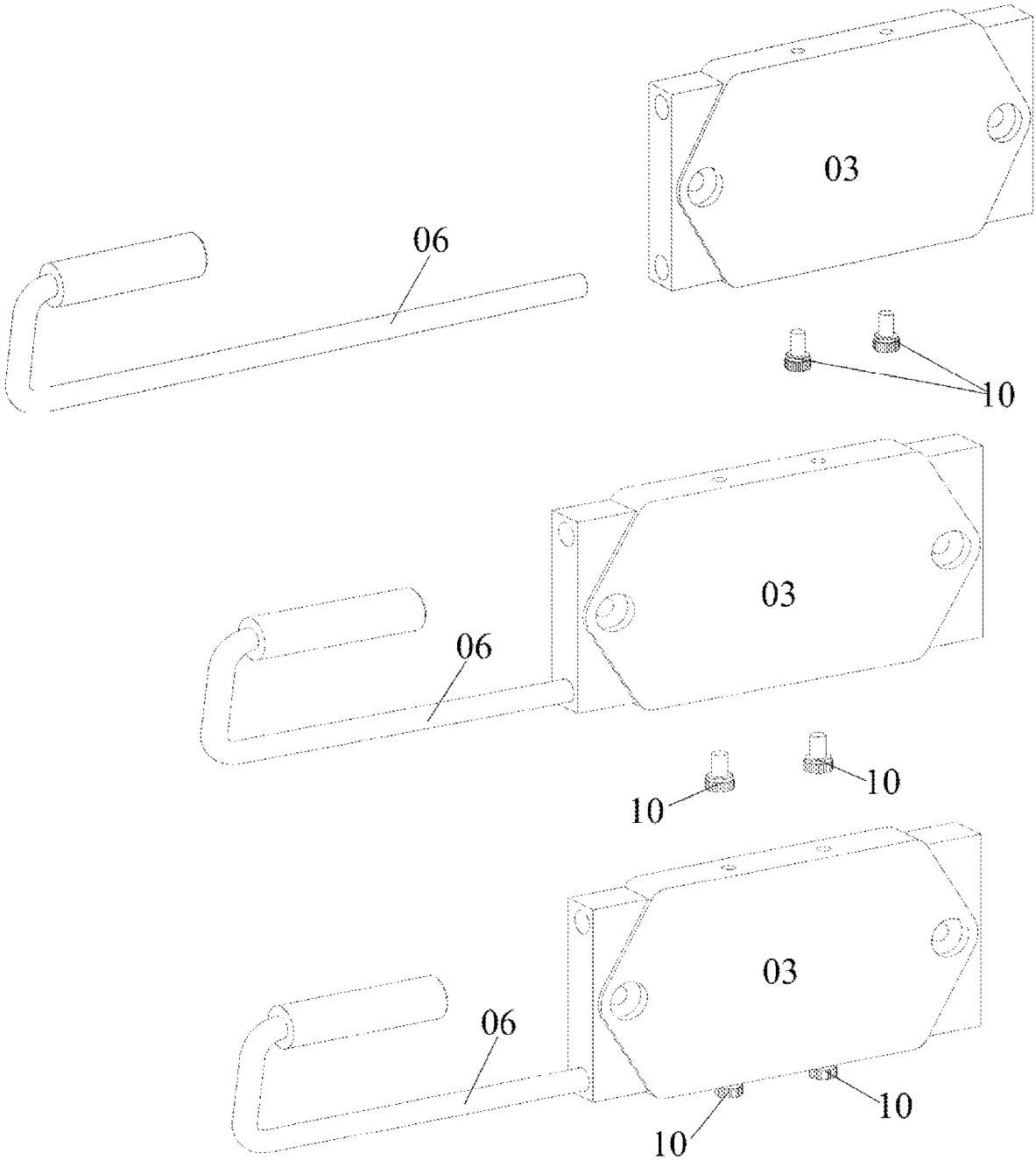
FIG. 8 shows a rotatably adjustable shaft secured to the mounting plate in accordance with an exemplary embodiment of the present invention.

As shown in FIG. 1, magnet mount 01 may include a rotatably adjustable shaft 06 passing through, and adjustably secured to, the mounting plate 03. In preferred embodiments, the rotatably adjustable shaft 06 is substantially in parallel with the surface 03S of the mounting plate 03 or the elongation direction of the firearm barrel 07. For example, shaft 06 may be made rotatably adjustable using for example a shaft-hole structure with one, two or more screws 10 as shown in FIG. 8.

In preferred embodiments, barrel insert 05 is substantially in parallel with the rotatably adjustable shaft 06. Magnet mount 01 includes a shaft-insert connector 08 that connects the barrel insert 05 and the rotatably adjustable shaft 06. Shaft-insert connector 08 may be substantially perpendicular to both the barrel insert 05 and the rotatably adjustable shaft 06.

Figure 4:
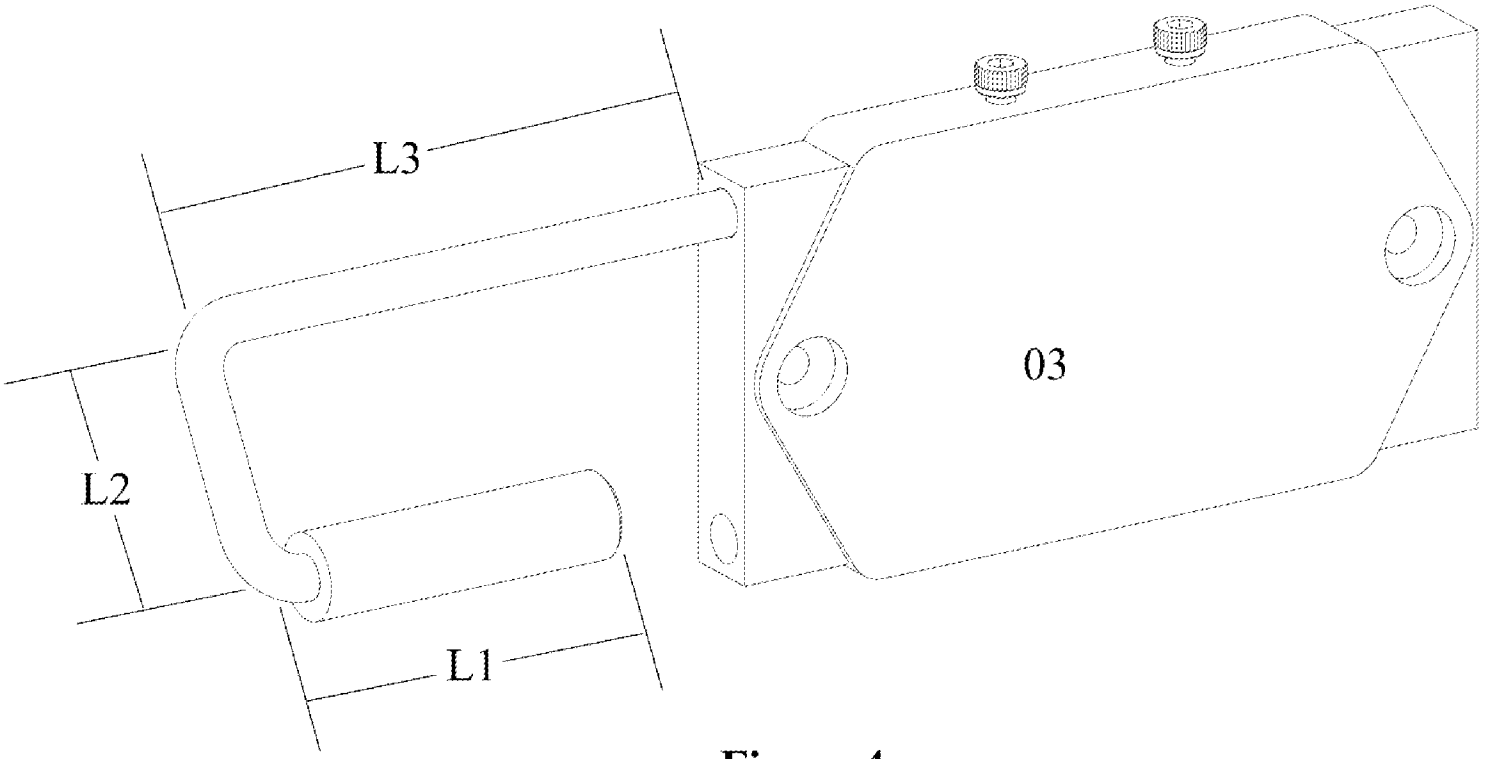
FIG. 4 depicts dimensions of the magnet mount in accordance with an exemplary embodiment of the present invention.

Referring to FIG. 4, the barrel insert 05 has a length of L1, the shaft-insert connector 08 has a length of L2, and the segment of the rotatably adjustable shaft 06 that is outside the mounting plate 03 has a length of L3. The ratio L2:L1 may be in the range of from 0.4:1 to 1:1, preferably from 0.5:1 to 0.9:1, and more preferably from 0.6:1 to 0.8:1 such as 0.7:1. The ratio L3:L1 may be in the range of from 0.2:1 to 2.2:1, preferably from 0.4:1 to 2:1, and more preferably from 0.8:1 to 1.8:1 such as 1.6:1. In a specific but still exemplary embodiment, L1=4 cm, L2=2.8 cm, and L3=6.4 cm.

Figure 5:
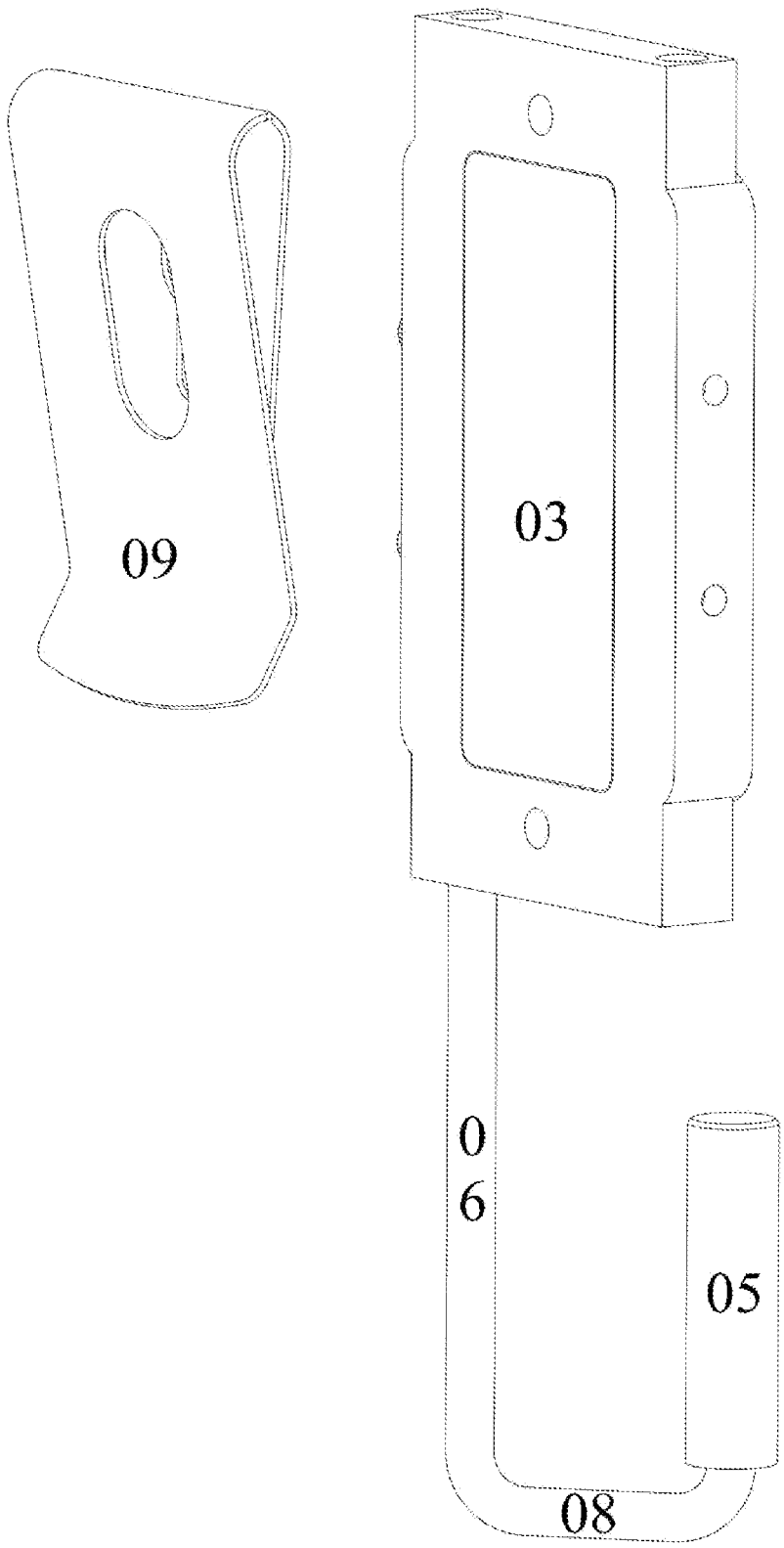
FIG. 5 schematically illustrates a clip to be added to the mounting plate in accordance with an exemplary embodiment of the present invention.
Figure 6:
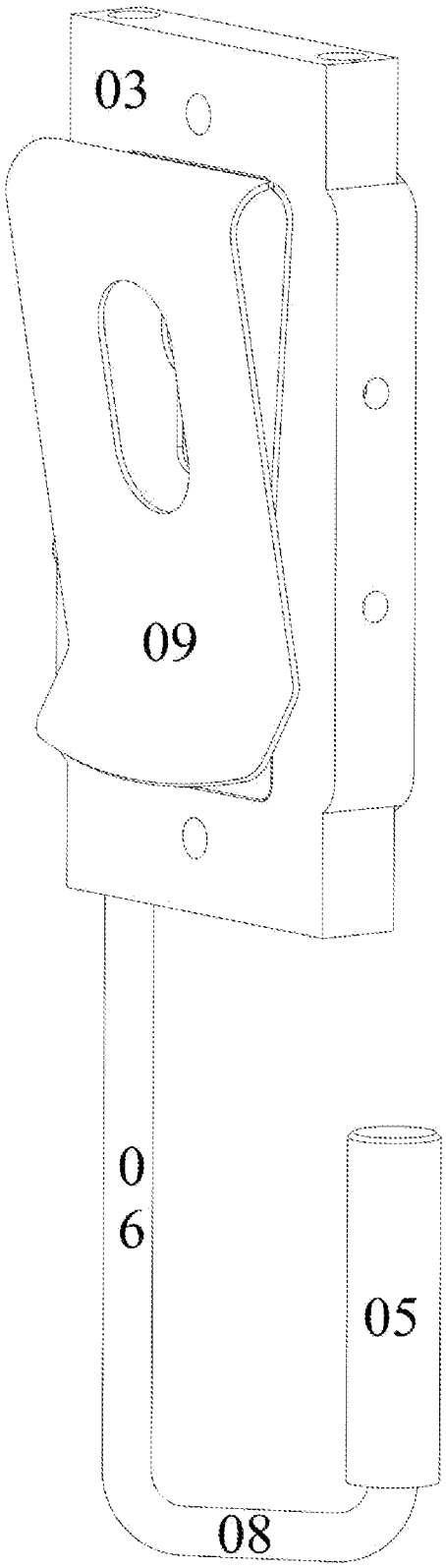
FIG. 6 schematically illustrates a clip added to the mounting plate in accordance with an exemplary embodiment of the present invention.
Figure 7:
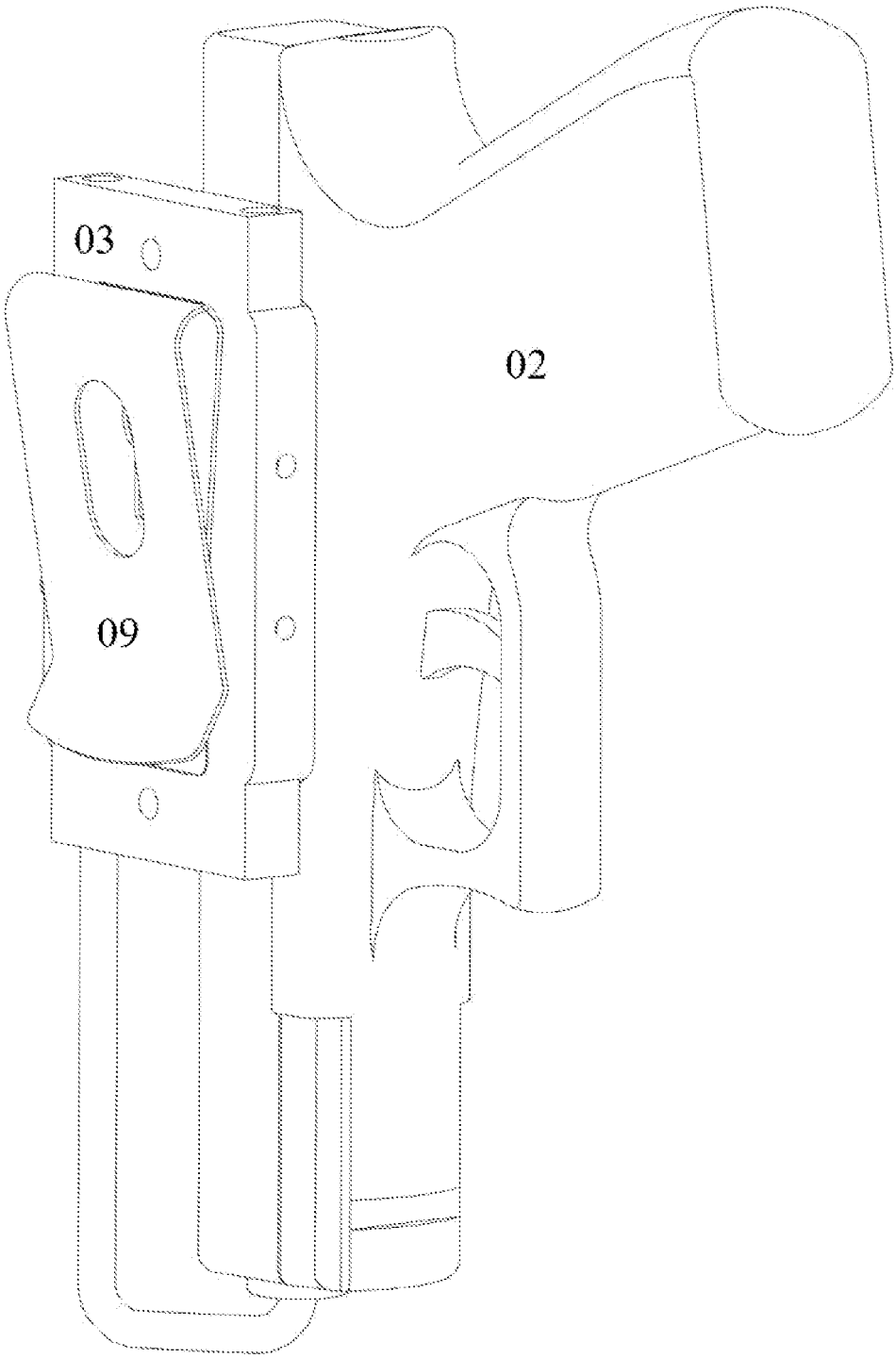
FIG. 7 schematically illustrates a magnet mount with the clip securely holding a firearm in accordance with an exemplary embodiment of the present invention.

In some embodiments as shown in FIGS. 5-7, a clip 09 is employed and configured for making the magnet mount 01 wearable. For example, clip 09 may be built as a belt holster spring clip.

An interface or a contacting interface between the mounting plate 03 and the firearm 02 can be adjusted by rotating the firearm 02 around the barrel insert 05 and/or by rotating the barrel insert 05 around the rotatably adjustable shaft 06, so that the mounting plate 03 may be placed next to (and contacting) one side (left/right side) of the firearm 02 (e.g. not blocking a line connecting the front sight and the rear sight of the firearm), as shown in FIG. 3.

Alternatively, the mounting plate 03 may be placed above the barrel 07 of the firearm 02 (e.g. the firearm part right above between the front sight and the rear sight of the firearm; or blocking a line connecting the front sight and the rear sight of the firearm 02), as shown in FIG. 1.

In various embodiments, the mounting plate 03 may be flat and configured for attaching to a surface such as walls, under desks, or inside vehicles, using for example screws, adhesive tape, hook-and-loop belt such as Velcro, or any combination thereof. The magnet mount of the invention may be configured for mounting a firearm selected from long-barreled guns such as carbine, rifle, shotgun, submachine gun, submachine gun, and machine gun; and handguns such as semi-automatic pistol, revolver, derringer, and machine pistol.

Magnets 04 as shown in FIG. 2 may be made of ferromagnetic metal such as iron, cobalt, and nickel; or alloy of rare earth elements such as neodymium magnets made from an alloy of neodymium, iron, and boron; and samarium-cobalt magnets; and preferably the magnets are strong and permanent neodymium magnets. In some embodiments as shown in FIG. 3, magnets 04 are encased and secured within the mount plate 03. In other embodiments, magnets 04 may be bonded to the mounting plate 03 (preferably onto the side facing the firearm). Magnets 04 may be coated with a rubber or polymer material for preventing the firearm 02 from getting scratched or damaged when the firearm 02 contacts magnets 04.

In various embodiments, mounting plate 03 may be made from a material such as steel, aluminum, rubber, plastic, and polymer. It may have grooves or ridges to stabilize the firearm 02 and prevent it from sliding off. It may have a shape of rectangular or square, and optionally it has rounded corners to prevent sharp edges that could cause injury or damage. Mounting plate 03 may have pre-drilled holes 11 as shown in FIG. 2 for screws, allowing for secure attachment to various surfaces. Alternatively, or additionally, mounting plate 03 may have an adhesive area, which can be used in addition to (or instead of) screws for attaching to various surfaces.

Figure 9:
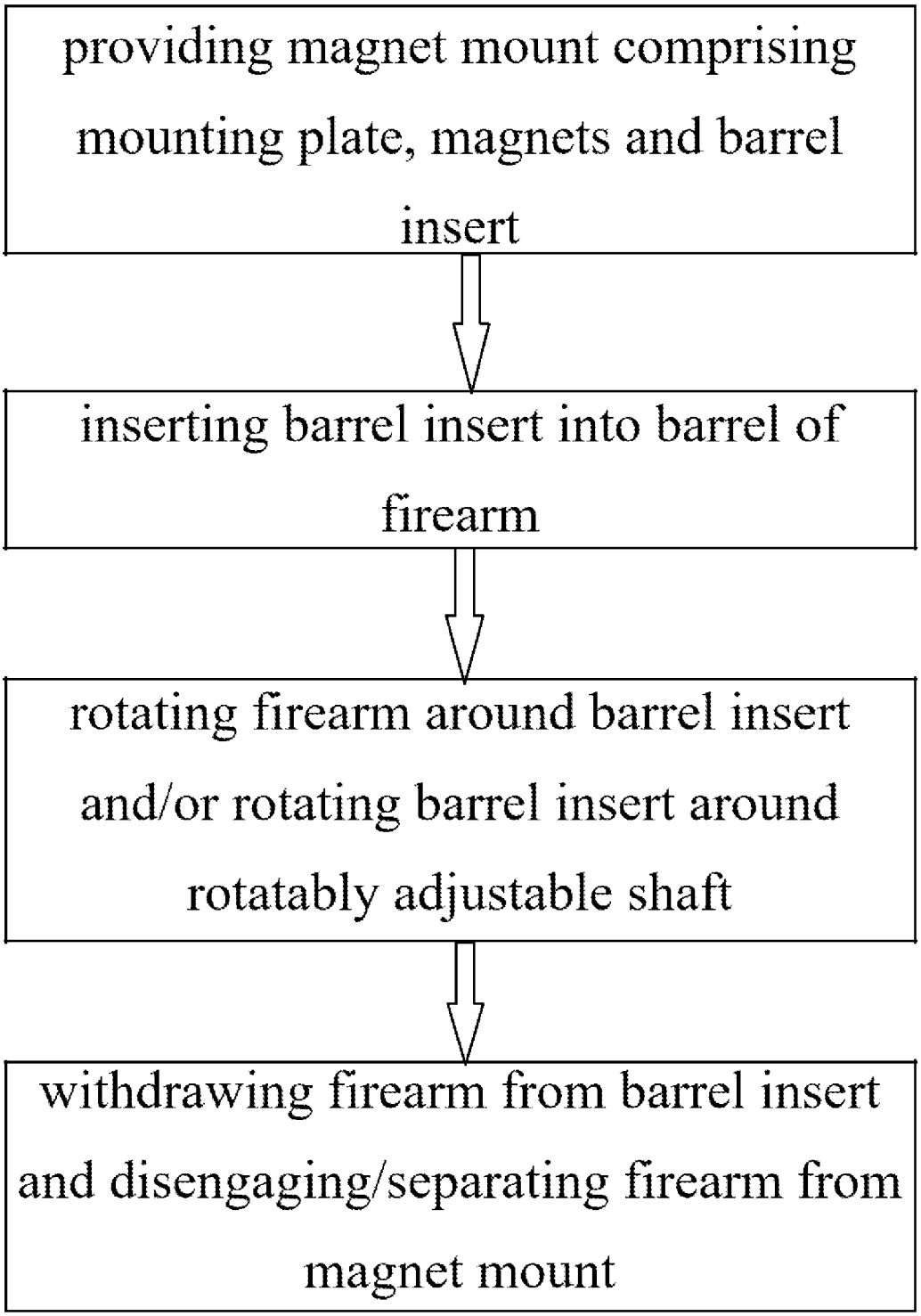
FIG. 9 is the flow chart of a method for securely holding a firearm in accordance with an exemplary embodiment of the present invention.

The present invention also provides a method of securely holding a firearm. In exemplary embodiments as shown in FIG. 9, the method includes providing a magnet mount as described above, for example comprising a mounting plate; one or more magnets affixed to the mounting plate; and a barrel insert substantially in parallel with a surface of the mounting plate. The method further includes inserting the barrel insert into the barrel of the firearm so that the barrel can rotate around the barrel insert and said one or more magnets can provide a holding power to support at least a portion of the weight of the firearm. Optionally, the method further comprises a step of rotating the firearm around the barrel insert and/or rotating the barrel insert 05 around the rotatably adjustable shaft 06, to adjust the contacting interface between the mounting plate and the firearm. Optionally, the method further comprises another step of withdrawing the firearm from the barrel insert, before completely disengaging/separating the firearm from the magnet mount.

In the foregoing specification, embodiments of the present invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicant to be the scope of the invention, is the literal and equivalent scope of the set of claims that issue from this application, in the specific form in which such claims issue, including any subsequent correction.

The invention claimed is:

1. A magnet mount for securely holding a firearm, comprising:

(i) a mounting plate;

(ii) one or more magnets affixed to the mounting plate, wherein said one or more magnets are configured for providing a holding power to support at least a portion of the weight of the firearm;

(iii) a barrel insert that is substantially in parallel with a surface of the mounting plate, wherein the barrel insert can be inserted into the barrel of the firearm and stabilizes the firearm; and wherein the barrel/firearm can rotate around the barrel insert; and (iv) a rotatably adjustable shaft passing through, and adjustably secured to, said mounting plate;

wherein the notably adjustable shaft is substantially in parallel with the surface of the mounting plate of the elongation direction of the firearm barrel.

2. The magnet mount according to claim 1, wherein the barrel insert is substantially in parallel with the rotatably adjustable shaft.

3. The magnet mount according to claim 1, further comprising a shaft-insert connector that connects the barrel insert and the rotatably adjustable shaft.

4. The magnet mount according to claim 3, wherein the shaft-insert connector is substantially perpendicular to both the barrel insert and the rotatably adjustable shaft.

5. The magnet mount according to claim 4, wherein the barrel insert has a length of L1, the shaft-insert connector has a length of L2, and a segment of the rotatably adjustable shaft that is outside the mounting plate has a length of L3;

wherein L2:L1 is in the range of from 0.4:1 to 1:1; and wherein L3:L1 is in the range of from 0.2:1 to 2.2:1.

6. The magnet mount according to claim 1, further comprising a clip configured for making the magnet mount (01) wearable.

7. The magnet mount according to claim 1, wherein an interface between the mounting plate and the firearm can be adjusted by rotating the firearm around the barrel insert or by rotating the barrel insert around the rotatably adjustable shaft, so that the mounting plate may be placed next to one side of the firearm or placed above the barrel of the firearm.

8. The magnet mount according to claim 1, wherein the mounting plate is flat and is configured for attaching to a surface including walls, under desks, or inside vehicles, using screws, adhesive tape, hook-and-loop belt including Velcro, or any combination thereof.

9. The magnet mount according to claim 1, which is configured for mounting a firearm selected from long-barreled guns including carbine, rifle, shotgun, submachine gun, submachine gun, and machine gun; and handguns including semi-automatic pistol, revolver, derringer, and machine pistol.

10. The magnet mount according to claim 1, wherein said one or more magnets are made of ferromagnetic metal including iron, cobalt, and nickel; or alloy of rare earth elements including neodymium magnets made from an alloy of neodymium, iron, and boron; and samarium-cobalt magnets.

11. The magnet mount according to claim 1, wherein said one or more magnets are encased and secured within the mount plate.

12. The magnet mount according to claim 1, wherein said one or more magnets are bonded to the mounting plate; and said one or more magnets are coated with a rubber or polymer material for preventing the firearm from getting scratched or damaged when the firearm contacts said one or more magnets.

13. The magnet mount according to claim 1, wherein the mounting plate is made from a material including steel, aluminum, rubber, plastic, and polymer.

14. The magnet mount according to claim 1, wherein the mounting plate has grooves or ridges to stabilize the firearm and prevent it from sliding off.

15. The magnet mount according to claim 1, wherein the mounting plate has a shape of rectangular or square.

16. The magnet mount according to claim 1, wherein the mounting plate has pre-drilled holes for screws, allowing for secure attachment to various surfaces; wherein the mounting plate has an adhesive area, which can be used instead of screws for attaching to various surfaces; or wherein the mounting plate has an adhesive area, which can be used in addition to screws for attaching to various surfaces.

17. A method of securely holding a firearm, comprising:

(i) providing a magnet mount comprising a mounting plate; one or more magnets affixed to the mounting plate; a barrel insert substantially in parallel with a surface of the mounting plate; and a rotatably adjustable shaft passing through, and adjustably secured to said mounting plate, wherein the rotatably adjustable shaft is substantially in parallel with the surface of the mounting plate or the elongation direction of the firearm barrel; and (ii) inserting the barrel insert into the barrel of the firearm so that the barrel can rotate around the barrel insert and said one or more magnets can provide a holding power to support at least a portion of the weight of the firearm.

18. The method according to claim 17, further comprising a step of rotating the firearm around the barrel insert or rotating the barrel insert around the rotatably adjustable shaft, to adjust the interface between the mounting plate and the firearm.

19. The method according to claim 17, further comprising a step of withdrawing the firearm from the barrel insert, before completely disengaging/separating the firearm from the magnet mount.

* * * * *